United States Patent [19]

Beyersdorf

[11] 4,243,981

[45] Jan. 6, 1981

[54] IONIZATION FIRE-SIGNAL DEVICE

[76] Inventor: Hartwig Beyersdorf, Konsulweg 29, D-2409 Scharbeutz, Fed. Rep. of Germany

[21] Appl. No.: 961,642

[22] Filed: Nov. 17, 1978

[30] Foreign Application Priority Data

Nov. 25, 1977 [DE] Fed. Rep. of Germany ..... 2752690

[51] Int. Cl.[2] ..... G08B 17/10

[52] U.S. Cl. ..... 340/629; 250/381; 313/54

[58] Field of Search ..... 340/629; 250/381, 382, 250/384, 385, 389, 320; 313/1, 54

[56] References Cited

U.S. PATENT DOCUMENTS

| | | | |
|---|---|---|---|
| 3,728,706 | 4/1973 | Tipton et al. | 340/629 |
| 3,842,409 | 10/1974 | Mayer | 340/629 |
| 3,934,145 | 1/1976 | Dobrzanski et al. | 250/389 |
| 4,058,803 | 11/1977 | Scheidweiler | 340/629 |

FOREIGN PATENT DOCUMENTS

| | | |
|---|---|---|
| 2162788 | 7/1972 | Fed. Rep. of Germany . |
| 2403418 | 2/1975 | Fed. Rep. of Germany . |
| 2450601 | 5/1975 | Fed. Rep. of Germany . |
| 2520929 | 11/1975 | Fed. Rep. of Germany . |

*Primary Examiner*—John W. Caldwell, Sr.
*Assistant Examiner*—Daniel Myer
*Attorney, Agent, or Firm*—Lerner, David, Littenberg & Samuel

[57] ABSTRACT

An ionization fire-signal device is provided which is compact in construction so that it has a small axial height. The housing for the device includes an axial extending outer wall and a transversely extending front wall to form a cup shaped housing. An insulator, including an axially extending circular wall which forms an enclosure, is positioned inside the housing and cooperates with the housing to form a measuring chamber. The axial dimension of the circular insulator wall and outer housing wall are approximately equal. In addition, a reference chamber is formed between the circular wall of the insulator and the outer wall of the housing such that the reference chamber is arranged transversely adjacent to the measuring chamber. A radiation source for ionizing the measuring chamber and reference chamber is also provided. An electrical alarm signal circuit is also disposed between the circular insulator wall and the outer housing wall and is electrically connected to two electrodes in the measuring chamber and two electrodes in the reference chamber.

34 Claims, 9 Drawing Figures

IONIZATION FIRE-SIGNAL DEVICE

FIELD OF THE INVENTION

The present invention relates generally to ionization type fire-signal devices, and specifically to an improved device which is substantially compact in construction and includes a minimum axial height without increasing the transverse dimension of the device.

BACKGROUND OF THE INVENTION

Ionization type fire-signal devices are well-known in the prior art. Typically, such devices include a measuring chamber and a reference chamber, with electrodes disposed therein which are connected to an alarm circuit. When the smoke enters the measuring chamber, its resistance changes and operates to trigger the alarm signal when a preset threshold value is exceeded. Prior art devices of this type include, for example, German Offenlegungsschrift No. 24 50 601, and No. 25 20 929, and German Auslegeschrift No. 24 03 418, and U.S. Pat. No. 3,728,706, issued Apr. 17, 1973 to Tipton et al. In such prior art devices, those which include a measuring chamber and reference chamber are arranged such that the axial dimension of the housing is substantially greater than the axial dimension of the measuring chamber. This is caused by the fact that the measuring chamber and the reference chamber are arranged axially with the respect to each other so that the total height of the signal device is at least as great as the sum of the axial dimensions of the measuring chamber and the reference chamber. In another prior art device of the kind mentioned above, and known from German Offenlegungsschrift No. 21 62 788, the reference chamber is arranged transversely to the measuring chamber, at a distance therefrom, the measuring chamber extends axially beyond the reference chamber, and a housing having a larger axial height than either one of the chambers, surrounds these chambers, the axial height being further increased by a socket made of insulating material, and adjoining the rear end of the housing. Thus, the total axial height of the signal device is substantially greater than the axial dimension of the measuring chamber. Accordingly, it would be desirable to provide a signal device in which the measuring chamber and reference chamber are arranged therein such that the axial dimension of the device is as small as possible without simultaneously increasing the transverse dimension of the device.

Broadly, it is an object of the present invention to provide an improved signal device which meets the foregoing objective. Specifically, it is within the contemplation of the present invention to provide an improved ionization type fire-signal device which includes both a measuring chamber and a reference chamber therein such that the reference chamber is arranged transversely adjacent to the measuring chamber so that the axial dimension of the signal device is approximately equal to the axial dimension of the measuring chamber.

It is a further object of the present invention to provide an improved ionization type fire-signal device in which the reference chamber and measuring chamber are disposed therein in a compact manner to provide a device having a minimum axial dimension without simultaneously increasing the transverse dimension thereof.

SUMMARY OF THE INVENTION

Briefly, in accordance with the principles of the present invention, an improved ionization type fire-signal device is provided which includes a housing having an axially extending outer circular wall and a transversely extending front wall to form a cup-shaped housing. An insulator is also provided and includes an axially extending circular wall forming an enclosure and positioned inside the housing and cooperating therewith to form a measuring chamber disposed within the circular wall of the insulator. In order to minimize the axial dimension of the signal device, the axial dimension of the insulator's circular wall and the axial dimension of the outer circular wall of the housing are substantially or approximately equal. In addition, in order to further minimize the axial dimension of the signal device, a reference chamber is formed between the circular wall of the insulator and the circular wall of the housing such that the reference chamber is arranged transversely adjacent to the measuring chamber, with the circular wall of the insulator being between the measuring chamber and the reference chamber. In addition, at least one radiation source is provided for ionizing the measuring chamber and the reference chamber. Also, an electrical alarm signal circuit is disposed between the circular wall of the insulator and the circular outer wall of the housing in the space unoccupied by the reference chamber. Such an arrangement also provides a compact construction. The alarm signal circuit is electrically connected to two electrodes disposed in the measuring chamber and to two electrodes disposed in the reference chamber.

Advantageously, as a result of the arrangement of the measuring chamber, reference chamber, and alarm signal circuit in the signal device of the present invention, a compact signal device is provided having a minimum axial dimension without increasing the transverse dimension of the device. In this manner, the total axial dimension of the signal device is not significantly greater than the axial dimension of the measuring chamber or reference chamber.

BRIEF DESCRIPTION OF THE DRAWINGS

Further objects, features, and advantages of the present invention will become apparent upon the consideration of the following detailed description of a presently preferred embodiment when taken in conjunction with the accompanying drawings.

DETAILED DISCUSSION OF PREFERRED EMBODIMENTS OF THE INVENTION

The ionization fire-signal device as shown in FIGS. 1 to 5 has a housing 10 and an insulator 12, located practically in its entirety within this housing. The housing 10 has a flat, cup-like shape, open towards the rear and comprises a tubular outer wall 14 with an annular cross-section and a frontal wall 16 connected thereto in a single piece, and located at the axially outer end. In the embodiment, the housing 10 is made of metal and is given a fixed potential to serve as a shield. As a variation, it is equally possible to use a housing manufactured of plastic material which is metallized on its inner side, or else a metal housing with an electrically insulating outer coating, if there is a danger of voltages being applied from the outside which must be avoided.

Figure 3:
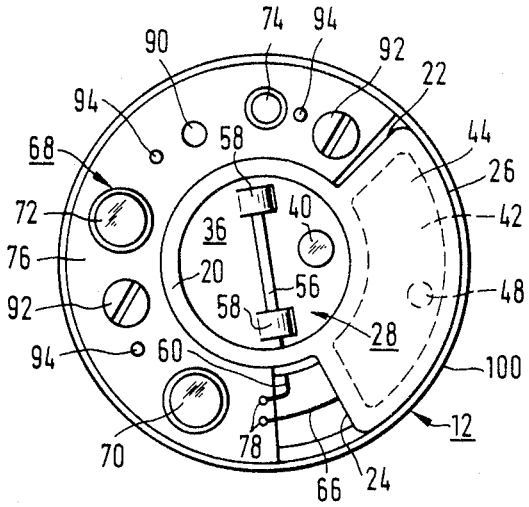
FIG. 3 is a plan view of the fire-signal device shown in FIG. 1 with the housing removed.
Figure 4:
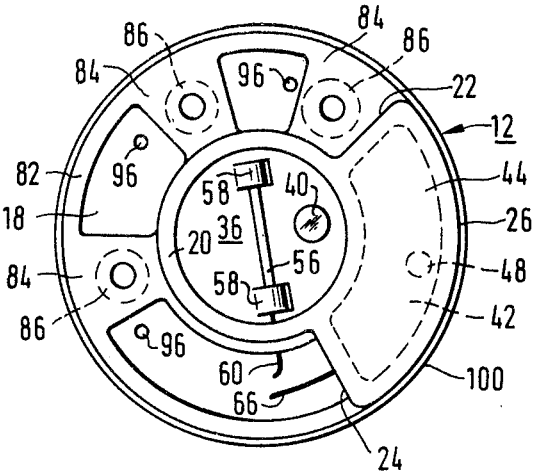
FIG. 4 is a plan view similar to FIG. 3, with the circuit plate and circuit elements also removed.
Figure 5:
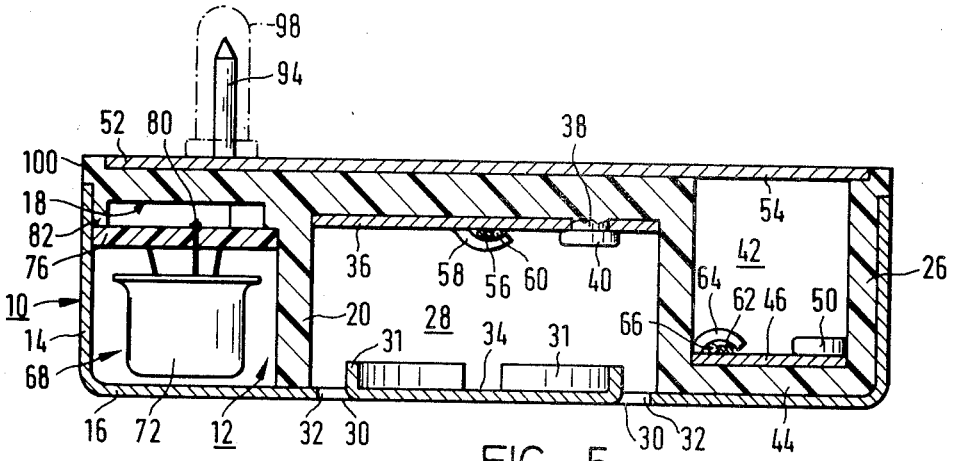
FIG. 5 is a cross-sectional view of the device taken along line V—V of FIG. 2.

The insulator 12, as can be seen from FIGS. 4 and 5, has a rear wall 18, parallel to the frontal wall 16 of the housing 10, lying approximately on a plane with the rear end of the outer wall 14 of the housing 10. The insulator 12 further has a tubular member 20 lying coaxially to the outer wall 14 of the housing 10, and arranged inside of the housing, which tubular member with its axially outer end abuts against the inner side of the frontal wall 16 of the housing 10, the dimensions of the cross-section of the tubular member 20 being smaller than the inside dimensions of the outer wall 14 of the housing 10; the inside diameter of the tubular member 20 is approximately 40% to 55% and preferably, as in the embodiment, 45% of the outer diameter of the cross-section of the outer wall 14 of the housing 10. As can be seen from FIGS. 1 to 4, the fire-signal device has a circular cross-section, while other cross section designs are equally conceivable, as, for instance, a cross-section approximating a square with rounded-off corners. In a design with a cross section different from a circular one, the aforementioned relation is still applicable to the inside dimensions of the tubular wall 20 as compared to the smallest outer dimension of the outer wall 14.

The tubular member 20 is, at its rear end, connected as a single piece with the rear wall 18, and, therefore, has at least approximately the same axial height as the housing 10. As can be seen from FIGS. 3 and 4, two axially parallel walls 22, 24 extend radially outward, away from the tubular member 20, as far as the inner side of the outer wall 14 of the housing 10. These walls 22, 24 abut with their axially outer edges on the inner side of the frontal wall 16 of the housing 10, they are of approximately the same height as the housing 10, and their rear ends are joined to the rear wall 18 as a single piece. A curved wall 26, adjacent to the inner surface of the outer wall 14 of the housing 10, connects in a single piece the radially outward lying ends of the two walls 22, 24, and has approximately the same axial height as the housing 10.

The measuring chamber 28 is formed inside the space surrounded by the tubular wall or member 20. In order to admit the ambient air into the measuring chamber 28, an annular opening 32, or slit, which is divided by radial bridges 30 is provided in the frontal wall 16 of the housing 10, the outer diameter of the opening 32 being equal to the inner diameter of the tubular wall 20, and the radial width of the opening being small compared to its diameter. One of the elctrodes of the measuring chamber 28 which has a fixed potential is formed by the area 34 of the frontal wall 16 of the housing 10, which area 34 spans the measuring chamber 28, i.e. by the portion of the frontal wall 17 lying inside the area of the opening 32. The flat electrode 34 thus formed has a counterpart in the equally flat electrode 36 located at the rear of the measuring chamber 28, which electrode has a discoid cross-section with an outer diameter equal to the inside diameter of the tubular wall 20. This inner electrode 36 is fastened to and immediately rests on the rear wall 18 which in the embodiment covers the rear end of the tubular wall 20 as a circular disc. For the attachment of the inner electrode 36 on the rear wall 18, the latter is provided with a cam 38 which traverses a small opening of the electrode 36, the outer end of this cam being heat-moulded into an enlarged head 40 resting against the outer side of the electrode 36.

For the protection of the measuring chamber 28 from ambient air streaming against it with increased speed, a tubular apron 31 is provided, extending axially into the measuring chamber 28 from the radially inner rim of the opening 32, i.e., from the radially outer rim of the area 34 of the frontal wall 16 of the housing 10, the tubular shape being interrupted at those points of the circumference which correspond to the bridges 30. The axial height of this apron 31 is at least approximately equal to the radial width of the opening 32. In this manner it is possible to bend the apron 31 out of the material of the housing 10 in a single punching operation, and thereby create the opening 32. It is practical to perform this punching operation simultaneously with the manufacture of the housing 10 which is produced by the moulding of a plane blank.

The reference chamber 42 is formed inside of the space surrounded by the radially extending walls 22, 24, the curved wall 26 and its radially opposite sector of the outer side of the tubular wall 20. At its outer end, facing the frontal wall 16 of the housing 10 the reference chamber 42 is closed off by a wall 44, which is parallel to the rear wall 18, adjacent to and abutting against the frontal wall 16, which wall 44 is formed as a single piece with the tubular wall 20, both of the radially extending walls 22, 24 and the curved wall 26. At the rear surface of the wall 44 there is a flat electrode 46, electrically connected with the inner electrode 36 of the measuring chamber 28, fastened to and immediately resting upon said rear surface and having the same curved segment-shaped ground plan as the reference chamber. Again, as a fastening means, a cam 48, as indicated in FIGS. 3 and 4 is provided, which in this instance protrudes from the wall 44 and is moulded to form an enlarged head 50 (FIG. 5).

The rear side of the insulator 12 is covered by a cover plate 52 with outside dimensions that approximate the dimensions of the cross section of the housing. In the embodiment shown the cover plate 52 is made of metal, but, as a modification, it could, if so desired, be made of a plastic material, its outer side, facing the rear wall 18 being metallized. The cover plate thus prevents electrical interference radiation from entering the inside of the signal device. In the embodiment, the rear wall 18 extends around the tubular wall 20 in the circumferential direction only in the area left unoccupied by the reference chamber 42, covering, however, that entire circumferential area, so that only the rear end of the reference chamber 42 is left exposed in the direction of the cover plate 52. In this manner, the cover plate 52 serves in its area 54, which spans the reference chamber 42, as one electrode of the reference chamber 42, having a fixed potential.

For the ionization of the measuring chamber 28 a diametrically extending, robbon-shaped radiation source 56 is provided on its electrode 36. To serve as an attachment means on that electrode 36, hooks 58 are punched out of said electrode and bent over onto the outside of the ends of the radiation source 56. Clamped beneath one of the hooks 58 there is an electrical conductor 60 which leads through an opening in the tubular wall 20 radially outward and serves as a connection with the electrode 46 of the reference chamber 42. Correspondingly, there is in the reference chamber 42, running nearly tangentially to the tubular wall 20, a ribbon-shaped radiation source 62, held on the electrode 46 by means of hooks 64 and also, clamped beneath a hook 64 is an electrical conductor 66 which leads through an opening in the radially extending wall 24 in the direction of the circumference out of the reference chamber 42 in order to establish the connection with the electrode 36 of the measuring chamber 28.

Whenever smoke enters the measuring chamber 28, its resistance changes. Inasmuch as the areas 34, 54 of the housing 10 and the cover plate 52, respectively, which serve as electrodes have fixed, differing potentials, a variation of the resistance of the measuring chamber 28 changes the potential of the inner electrode 36 and the electrode 46 connected thereto, which phenomenon can be utilized for the triggering of an alarm signal in the usual manner by means of an alarm signal circuit, its input being connected with the electrodes 36, 46, as soon as the aforementioned change in the potential passes a preset threshold value. A suitable alarm signal circuit 68 is located in the circumferential space left unoccupied by the reference chamber 42 between the tubular wall 20 and the inner side of the outer wall 14 of the housing 10 and inside of said housing. The alarm signal circuit 68 comprises circuit elements 70, 72, 74 and a circuit plate 76 on which they are mounted. The signal element 70 is, for instance, an input field-effect transistor, its control electrode being connected by way of soldering points 78, formed on the circuit plate, with the conductors 60, 66 and, therefore, with the electrodes 36, 46. The circuit element 72 may be a further transistor or else an integrated circuit cupped in a transistor housing, combining several transistor and/or resistor functions. The circuit element 74 is a light-emitting diode which in case of an alarm condition lights up and indicates that condition; the spherical cap of the diode rises through an opening in the frontal wall 16 of the housing 10 and is therefore visible from all sides. The conductors provided for the circuit connection between the circuit elements 70, 72, 74 are affixed as a printed circuit on the reverse side of the circuit plate 76, facing the rear wall 18 and are not shown in detail.

As can be seen from FIG. 5, the circuit plate 76, having a ground plan in the shape of an annular sector, is fastened at a distance from the outer side of the rear wall 18, which distance is small compared to the axial height of the housing 10. In this manner, a space of sufficient height is available between the circuit plate 76 and the rear wall 18 to accomodate the ends of the connectors of the circuit elements 70, 72, 74 coming through the circuit plate and also the soldering points 80 which connect these ends with the printed circuit. In order to safeguard the mentioned distance, spacers are formed on the outer side of the rear wall 18. A rim 82 provided in the area of the circumference not occupied by the reference chamber 42 acts as such a spacer; it protrudes axially forward and abuts with its radially outer edge on the inner side of the outer wall 14 of the housing 10. At the same time, this rim 82 improves the mechanical rigidity of the insulator 12 to withstand forces affecting the outer circumference of the rear wall 18 which is particularly advantageous in view of the small dimensions of the insulator 12. Additional spacers for the circuit plate 76 are formed by elevations on the rear wall 18 which extend radially from the tubular wall 20 as far as the rim 82 and on which rests the circuit plate 76. These elevations 84 have recesses 86 located at the reverse side of the rear wall 18, holding screw nuts which are insulated from the cover plate 52 and are not shown in detail. A flat-head screw 88 (FIG. 2) is screwed into one of these nuts as fastener for the housing 10, traversing its frontal wall 16 as well as an opening 90 in the circuit plate 76 and also an opening in the elevation 84 aligned therewith. The opening 90 of the circuit plate has an electrically conductive plating which results in the electrical connection between the housing 10 and one conductor of the circuit plate 76. In order to fasten the circuit plate 76 to the rear wall 18, screws 92 are screwed into the remaining screw nuts, which screws also pass through the circuit plate 76 and the associated elevation 84.

In the circuit plate 76 male plugs 94 are held serving for the voltage supply and the signal transmission, passing through guide bores 96 in the rear wall 18 and protruding from the reverse side of the rear wall 18. One of the plugs may be in an electrically conductive connection with the cover plate 52, while the other plugs 94 pass through the cover plate electrically insulated therefrom. The plugs 94 may be attached to connecting wires or soldered to the printed circuit of an additional circuit plate which carries the signal device. Should a plug connection be desired as, for instance, a connection with an installation base carrying the fire-signal device, hollow male plugs 98, having a larger diameter, may be slipped over and soldered to the plugs 94. It is also possible to solder plugs 98 which are not connected with the plugs 94 into a circuit plate and to use the plugs 98 as female plugs for the male plugs 94.

As can be seen especially from FIG. 5, the rear wall 18 and the curved wall 26 of the insulator 12 have a surrounding annular flange, or rim 100. On the one hand, this rim forms a widened area upon which the rear rim of the outer wall 14 of the housing 10 axially rests and the radially outer side of which is flush with the outer surface of the outer wall 14 of the housing 10; and on the other hand, the rim also forms an axial extension surrounding the radially outer edge of the cover plate 52, its rear side being flush with the reverse side of the cover plate 52. In this manner, a suitable insulating distance is obtained between the housing 10 and the cover plate 52, which has a different potential, and the ring 100 at the same time serves as a further mechanical reinforcement of the insulator 12. For this last stated reason, this ring is also provided with the further embodiments yet to be described, in which the housing 10 and the cover plate 52 have the same potential.

The radioactive rays from the radiation sources 56, 62 in the measuring chamber 28 and in the reference chamber 42, respectively, which are mostly alpha rays if radium is used as the material for the radiation sources 56, 62, have a range which is far greater than the dimensions of the signal device and they are, therefore, in many cases repeatedly reflected within the chambers 28, 42, particularly at the electrodes. In the example of the measuring chamber 28, reflected rays may escape the measuring chamber 28 through the opening 32, while this is not possible with the reference chamber 42. Therefore, the reference chamber 42 may have a smaller volume than the measuring chamber 28 where the activities of the two radiation sources 56, 62 are equal to each other; the suitable volume of the reference chamber is 50% to 85% and, preferrably, as in the embodiment shown, approximately 70% of the volume of the measuring chamber 28. Of course, in order to prevent a pollution of the environment, the activities of the radiation sources 56, 62 are kept to a minimum; in the embodiment they are less than 0.1 microcurie each.

In order to execute the mentioned volume relations with an inside diameter of the tubular wall 20 as already mentioned above relative to the outside diameter of the housing 10, it is practical that the radially extending walls 22, 24 should be at an angular distance of 80° to 140° from each other, this space being filled by the reference chamber 42; in the embodiment this angular distance is 110°. Such an angle which is not too large has the advantage that in a simple manner practically the entire volume of the reference chamber 42 may be ionized by means of a single linear-ribbon-shaped radiation source and that the circumferential space left unoccupied by the reference chamber 42 is still sufficiently large to accommodate without difficulty not only the circuit elements 70, 72, 74 of the signal circuit, but also the fastening means such as the screws 88, 92, and the connecting elements such as the plugs 94.

The axial height of the housing 10 is approximately 20% to 50% of the smallest dimension of its cross-section. In the embodiment the total height as measured from the reverse side of the cover plate 52 to the outer side of the frontal wall 16 of the housing 10 is 9.65 mm, while the outside diameter of the outer wall 14 of the housing 10 is 33.2 mm, so that the axial height is approximately 29% of the outside diameter. If, in a modification departing from the circular cross-section, a design with a cross-section approximating a square should be chosen, the reference chamber may be located in a corner space, and its desired volume relative to the measuring chamber may be obtained with a slightly enlarged diameter of the tubular wall 20, resulting in a still flatter construction, which, however, results in costlier manufacture because of the somewhat more complicated shape.

Figure 1:
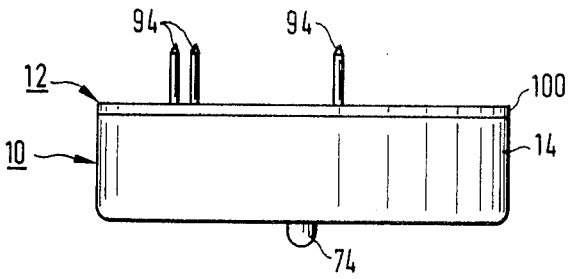
FIG. 1 is an elevational view of an ionization fire-signal device in accordance with the present invention.
Figure 2:
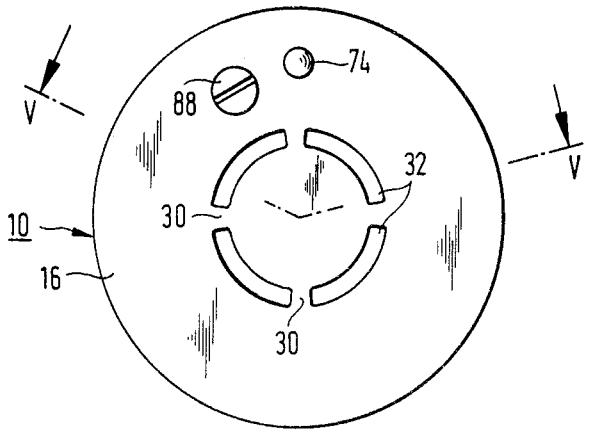
FIG. 2 is a bottom plan view of the device of FIG. 1 illustrating the front wall of the device.
Figure 6:
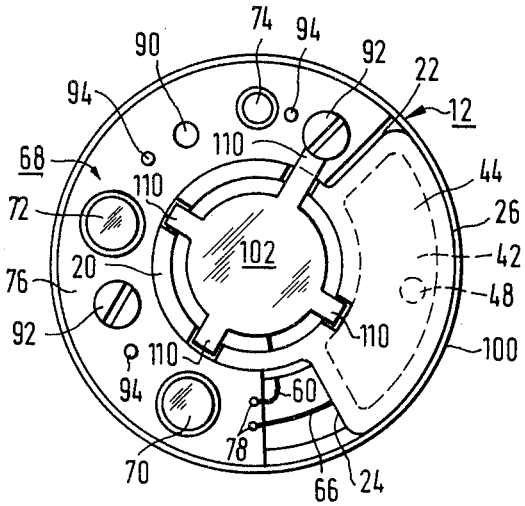
FIG. 6 is a plan view of an alternative embodiment with the housing removed.
Figure 7:
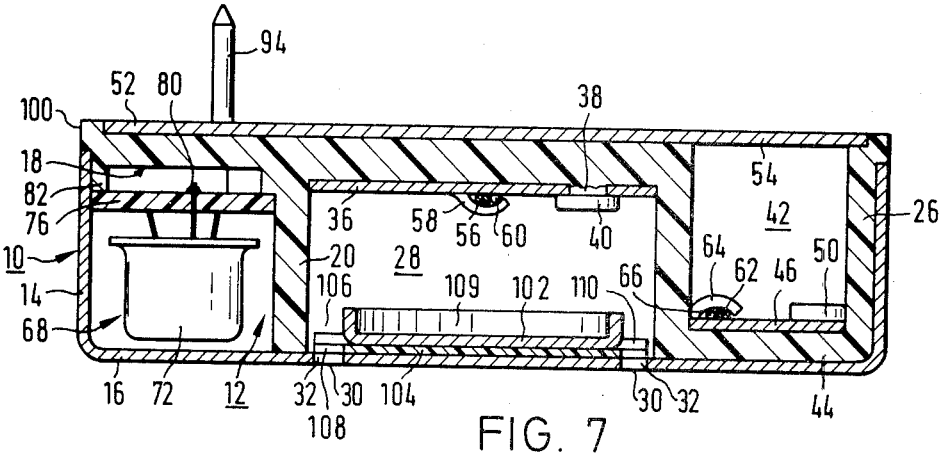
FIG. 7 is a cross-sectional view of the embodiment of FIG. 6.

The drawings of FIG. 1 and 2 also apply to the embodiment shown in FIGS. 6 and 7; identical parts are marked with identical reference symbols. Departing from the embodiment according to FIGS. 1 to 5, the ionization fire-signal device of FIGS. 6 and 7 has an outer electrode 102 of the measuring chamber 28, arranged separated by an insulating layer 104, tightly adjoining the area 34 of the housing 10 which spans the outer end of the tubular wall 20, so that the electrode 102 may have a polarity different from that of the housing 10, and the housing 10 as well as the screening plate 52 may have the same potentials. Thus, they serve together as a Faraday cage surrounding the remainder of the parts of the signal device. The electrode 102 has a slit 106 aligned with the opening 32 of the frontal wall 16 of the housing, to admit the ambient are, the insulating layer also having such a slit 108. To serve as an attachment means, the electrode 102 has extensions 110 dividing the slit 106 along its circumference and extending radially, which extensions mate with recesses formed in the outer rim of the tubular wall 20; one of the extensions 110 is continued downwards along the outside of the tubular wall and to the circuit plate 76 and there is connected with one conductor by means of one of the screws 92.

For the protection of the measuring chamber 28 from stronger currents of ambient air, the embodiment according to FIGS. 6 and 7 provides an apron 109, axially extending from the radially outer rim of the outer electrode 102 into the measuring chamber 28, tubular in shape, but possibly interrupted at the circumferential points corresponding to the radial extensions 110. The outside diameter of this apron 109, therefore, is equal to the inside diameter of the openings 32, 108, 106. In most applications, it suffices that the apron 109, as in the embodiment shown, is of low axial height by comparison with the axial height of the measuring chamber 28. Should there be an increased need for a shielding from high-velocity currents of ambient air, if, for instance, the fire-signal device should be used in air conditioning ducts, the axial height of the apron 109 may be selected so as to be up to one half of the axial height of the masuring chamber 28; inasmuch, however, as the apron 109 in this case becomes effective as part of the outer electrode 102 and influences the distribution of the electrical field inside the measuring chamber 28, it may become necessary to use outer dimensions for the inner electrode 36 that are smaller than the inner dimensions of the tubular wall 20.

In the embodiment according to FIGS. 6 and 7, given a required axial height of the measuring chamber 28, the total height of the signal device becomes higher by the axial thicknesses of the electrode 102 and the insulating layer 104, than the total height of the embodiment shown in FIGS. 1 to 5. If desired, such an increase in the axial height may largely be avoided by providing the frontal wall 16 of the housing 10 with a circular opening with a diameter equal to the inner diameter of the tubular wall 20 in the place of the central area 34 and its bridges 30, and by holding the electrode 102 in this opening by means of suitably bent extensions 106 in such a manner that it lies in the same plane with the frontal wall 16 of the housing 10. In order to prevent a possible short-circuit between the electrode 102 and the housing 10 in this case, it is further advisable to coat the outside of at least one of the aforementioned parts with an insulating layer.

Figure 8:
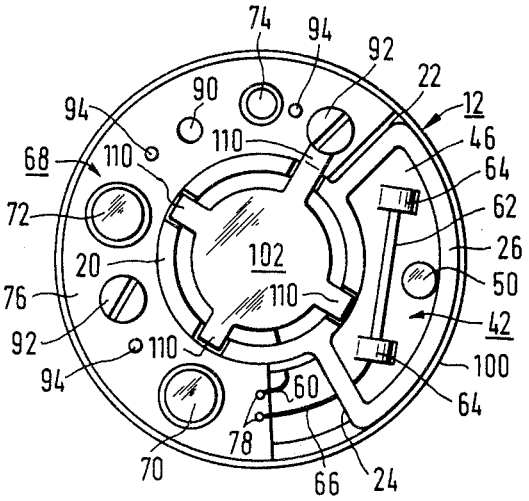
FIG. 8 is a plan view of a third embodiment of the present invention with the housing removed.
Figure 9:
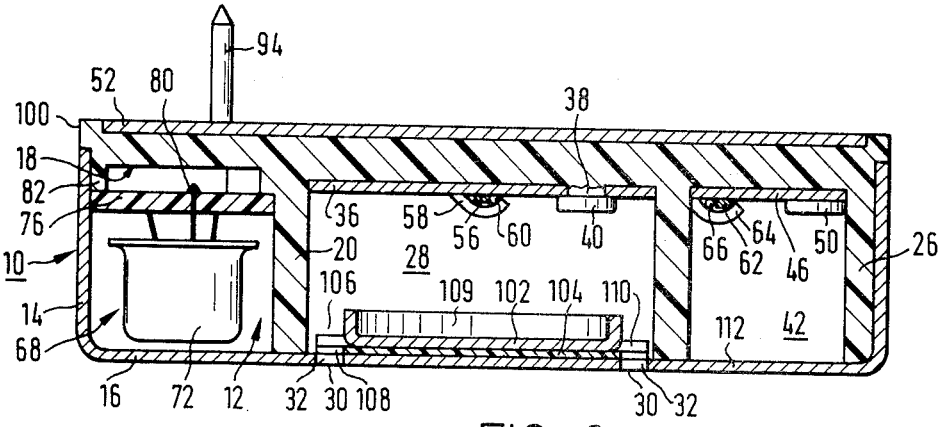
FIG. 9 is a cross-sectional view of the embodiment of FIG. 8.

The embodiment shown in FIGS. 8 and 9 is still another modification of the one shown in FIGS. 6 and 7; identical or identically functioning parts are given the identical reference symbols. Otherwise, the drawings of FIGS. 1 and 2 are again applicable.

The fire-signal device of FIGS. 8 and 9 is primarily characterized by the reference chamber 42 at its rear end being closed off by a wall section parallel to the rear wall 18, and, in the embodiment shown, formed by a circumferential segment of said rear wall 18, and that the electrode 46 which is connected with the electrode 36 of the measuring chamber 28 is fastened onto the outer side of this wall segment of the rear wall 18, abutting directly against it, being mounted by means of a cam with a head 50. In this embodiment, the wall 44 of the previously described embodiments and which closes off the reference chamber 42 against the frontal wall 16 of the housing 10 is dispensed with. Thus, an area 112 of the rear side of the frontal wall 16 of the housing 10 lies exposed within the reference chamber 42 and serves as an electrode of the reference chamber 42.

As variations of the embodiments shown, one can imagine additional differently modified arrangements of the electrodes in the reference chamber 42. Thus, as an example, the reference chamber 42 may be closed off from the cover plate 52 as well as from the frontal wall 16 of the housing 10 by insulating walls, one of these walls, however, in this case not being manufactured as a single piece with the insulator, so that both electrodes of the reference chamber 42 may be kept on potentials which differ from that of the housing 10 and the cover plate 52. This measure may be necessary if the alarm signal circuit 68 has a feed-back resistor connected between one electrode of the measuring chamber and a fixed potential, which resistor is shorted after a reaction of the signal device, in order to obtain a feed-back effect. It is further conceivable to position the two electrodes of the reference chamber 42 radially facing each other on the outer side of the tubular wall 20, and on the inner side of the curved wall 26, respectively.

With the ionization fire-signal device of the invention, a signal device of this type has been created for the first time which is of such low construction height that it belongs into the size range of circuit elements commonly used on circuit plates of electrical equipment and particularly electronic data processing systems. It is therefore possible to utilize the signal device in the fire protection of a vertically arranged circuit plate of this kind by attaching it upon such a plate itself, preferably near its upper edge. In this manner, considerably improved fire protection is obtained as compared to past solutions where the ionization fire-signal device was arranged separately from and above the circuit plate, for instance in an exhaust duct.

Modifications of the fire-signal device embodiments as shown are possible in numerous ways. As an example, instead of the ribbon-shaped radiation sources 56, 62 which ionize the measuring chamber 28 and the reference chamber 42, one single radiation source for the ionization of both chambers 28, 42 may be provided, arranged in a window of the particular sector of the tubular wall 20 which is located between the measuring chamber 28 and the reference chamber 42. The radiation source in this case is appropriately so constructed that at least one of its surfaces facing the measuring chamber 28 and the reference chamber 42 has an electrically insulating effect, and it is suitably so arranged in the window that it seals it off, so as to prevent the occurrence of electrical creepage between the measuring chamber 28 and the reference chamber 42.

What is claimed is:

1. An ionization fire-signal device, comprising:

a housing including an axially-extending tubular outer wall and a transversely-extending front wall, the axial dimension of said housing being less than the transverse dimension thereof;

an insulator positioned inside said housing and including a tubular inner wall positioned coaxially relative to said tubular outer wall;

said housing including a concentric section between said tubular inner wall and said tubular outer wall;

the outer transverse dimension of said tubular inner wall being less than the inner transverse dimension of said tubular outer wall, and the axial dimension of said tubular inner wall and of said tubular outer wall being approximately equal;

said tubular inner wall forming an enclosure for a measuring chamber, said measuring chamber including at least one opening in the front wall of said housing for access of ambient air, said measuring chamber containing two electrodes;

two spaced-apart insulating walls positioned in said concentric section and extending radially between said tubular inner wall and said tubular outer wall and forming an enclosure for a reference chamber;

said reference chamber extending around a part of said measuring chamber;

said reference chamber containing two electrodes electrically connected in series with the two electrodes of said measuring chamber;

at least one radiation source for ionizing said measuring chamber and said reference chamber;

an electrical alarm signal circuit electrically connected to the electrodes of said measuring and reference chambers; and the circuit elements of said signal circuit being disposed in said concentric section between said tubular inner wall and said tubular outer wall, and insulated from said reference chamber by said insulating walls.

2. A device according to claim 1, wherein the axial wall of said insulator includes an outer end which abuts the front wall of said housing.

3. A device according to claim 1 wherein said opening is formed in the front wall of said housing and is located inwardly from the axial wall of said insulator.

4. A device according to claim 3 wherein said opening in said front wall is a ring-shaped slit, interrupted by radial bridges.

5. A device according to claim 1 wherein the front ends of the radially extending walls of the insulator defining the reference chamber abut the front wall of said housing.

6. A device according to claim 5 wherein said insulator includes a curved wall connecting the radial outer ends of said radially extending walls, said curved wall being adjacent to the outer wall of said housing to insulate said reference chamber from said housing.

7. A device according to claim 1 wherein at least one of the electrodes of the measuring chamber is flat and is positioned at right angles to the axial wall of said insulator.

8. A device according to claim 7 wherein said housing is electrically conductive, at least in the area which covers the front end of the measuring chamber, and that said area of the housing serves as an electrode of the measuring chamber.

9. A device according to claims 7 or 8, further including an apron, axially extending into the measuring chamber adjacent said opening for limiting the entry of ambient air to said measuring chamber.

10. A device according to claim 8 wherein a flat electrode of the measuring chamber is positioned across said area of the housing which spans the front end of the measuring chamber, an insulating layer between said flat electrode and said area, said flat electrode being dimensioned so as to leave an opening around said flat electrode for access of the ambient are.

11. A device according to claim 10 wherein an apron extends axially into the measuring chamber from the radially outer rim of said flat electrode, said apron having an axial height which is small compared to the axial height of the measuring chamber.

12. A device according to claim 1 wherein the electrodes of the reference chamber are flat, and are positioned at right angles to the axial wall of said insulator.

13. A device according to claim 1 wherein said insulator has a rear wall connected with the rear end of said insulator axial wall and lying at right angles to the axis of said insulator axial wall, said rear wall extending radially outward as far as the rear edge of the outer wall of the housing.

14. A device according to claim 13 wherein said rear wall covers the rear end of the measuring chamber, an electrode being disposed on said rear wall within said measuring chamber.

15. A device according to claims 13 or 14, wherein said rear wall is circular and extends in the circumferential direction over said alarm signal circuit.

16. A device according to claim 1 wherein the rear side of said insulator is covered by a cover plate, electrically conductive at least on one of its sides, and having a fixed electrical potential.

17. A device according to claim 1 wherein said reference chamber at its front end is closed off by an insulating wall of said insulator abutting the front wall of said housing, and on the other side of said insulating wall an electrode of the reference chamber is mounted.

18. A device according to claims 12, 16 or 17 further including a cover plate covering said reference chamber and which serves as an electrode thereof.

19. A device according to claim 1 wherein said reference chamber at its rear end is closed off by a wall sector of said insulator extending in a transverse direction, and on the outer side of said wall sector an electrode of the reference 20. A device according to claim 1 wherein the circuit elements of said alarm signal circuit are arranged on a circuit plate.

21. A device according to claim 20 wherein said circuit plate is held at a distance from the rear wall of said insulator by means of spacers.

22. A device according to claim 21 wherein said spacer is formed by a rim on said insulator axially protruding from the rear wall of said insulator, and with its outer side abutting against the inner side of the outer wall of said housing.

23. A device according to claims 21 or 22, wherein said spacer is formed by elevations in the rear wall of said insulator, said elevations having at their rear side means for fastening the housing and the circuit plate to the rear wall of said insulator.

24. A device according to claims 20 or 21 wherein male plugs are mounted in said circuit plate, said plugs extending through the rear wall of said insulator.

25. A device according to claim 1 wherein said insulator includes a rear wall and a curved wall having a surrounding annular flange, the rear edge of the outer wall of the housing axially abutting thereon, the radially outer side of said flange being flush with the outer side of the outer wall of the housing.

26. A device according to claim 25 further including a cover plate, said rear wall and said curved wall having an annular axial extension surrounding the radially outer edge of said cover plate.

27. A device according to claim 1 wherein the volume of the reference chamber is 50% to 85% of the volume of the measuring chamber.

28. A device according to claim 1 wherein the volume of the reference chamber is approximately 70% of the volume of the measuring chamber.

29. A device according to claim 1 wherein said measuring and reference chambers each include a radiation source having identical activities.

30. A device according to claim 1 wherein said insulator axial wall is circular in shape and the inner diameter thereof is 40% to 50% of the smallest outer dimension of the outer wall of said housing.

31. A device according to claim 1 wherein said insulator axial wall is circular in shape and the reference chamber surrounds the measuring chamber for an angle of 80° to 140°.

32. A device according to claim 31 wherein the reference chamber surrounds the measuring chamber for an angle of approximately 110°.

33. A device according to claim 1 wherein the axial height of the housing is 25% to 50% of its smallest transverse dimension.

34. A device according to claim 33 wherein the axial height of the housing is approximately 30% of its smallest transverse dimension.

* * * * *